US005111724A

United States Patent [19]

Kanaga et al.

[11] Patent Number: 5,111,724

[45] Date of Patent: May 12, 1992

[54] SLITTER KNIFE ARRANGEMENT

[75] Inventors: Bob C. Kanaga, Mesa; Ronald R. Beyerle, Higley, both of Ariz.

[73] Assignee: Gould Inc., Eastlake, Ohio

[21] Appl. No.: 703,406

[22] Filed: May 21, 1991

[51] Int. Cl.[5] ..... B26D 1/10

[52] U.S. Cl. ..... 83/58; 83/62.1; 83/74; 83/433; 83/434; 83/509; 83/522.11; 83/700

[58] Field of Search ..... 83/509, 700, 433, 434, 83/74, 58, 62.1, 522.11, 522.15

[56] References Cited

U.S. PATENT DOCUMENTS

| | | | |
|---|---|---|---|
| 1,151,527 | 8/1915 | Lewis | 83/434 |
| 1,255,098 | 1/1918 | Lewis | 83/509 |
| 1,996,176 | 4/1935 | Smith | 83/509 |
| 2,552,674 | 5/1951 | Haren | 83/434 |
| 2,623,580 | 12/1952 | Volpi | 83/509 X |
| 2,728,393 | 12/1955 | Brook | 83/434 X |
| 2,747,666 | 5/1956 | Brooks | 83/434 X |
| 3,441,232 | 4/1969 | Diebold et al. | 83/433 X |
| 3,468,203 | 9/1969 | Armelin et al. | 83/433 |
| 3,623,388 | 11/1971 | Gottling et al. . | |
| 3,682,031 | 8/1972 | Degelleke et al. | 83/700 X |
| 3,935,776 | 2/1976 | Dingus | 83/433 X |
| 4,058,037 | 11/1977 | Tashiro et al. | 83/509 X |
| 4,120,223 | 10/1978 | Bosse | 83/433 X |

*Primary Examiner*—Frank T. Yost
*Assistant Examiner*—Rinaldi Rada
*Attorney, Agent, or Firm*—D. Peter Hochberg; Mark Kusner; Louis J. Weisz

[57] ABSTRACT

A device for slitting a metallic foil which is continuously fed along a path comprising a support base having an elongated guide formed therein, the guide defining a generally linear guide path, and the support base being positionable adjacent the foil path and a blade holder dimensioned to be received within the guide and be movable along the guide path, the blade holder dimensioned to hold a cutting blade having a linear cutting surface wherein the linear cutting surface is oriented generally parallel to the guide path; and a reversible drive member secured to the base operable to reciprocally move the blade holder along the guide path at a controllable rate of speed.

6 Claims, 3 Drawing Sheets

SLITTER KNIFE ARRANGEMENT

FIELD OF THE INVENTION

The present invention relates generally to a device for trimming or slitting sheet material and more particularly to a device for slitting a continuously moving web of metal foil.

BACKGROUND OF THE INVENTION

Copper foil is widely used in the electronic industry and is generally produced by an electrodeposition process wherein continuous sheets, typically several feet in width and hundreds of feet in length, are produced. Such foil is typically used in the electronics industry in the production of circuit boards. To this end, it is necessary to cut the continuous sheet of copper foil into smaller sizes suitable for shipping and handling. Generally, the first step is to slit the continuous web into rolls of narrower width. In the art of slitting copper foil, it is generally known to continuously move the web over a plurality of generally stationary blades which intersect the path of the moving web. A problem with such arrangement, is that the stationary blades tend to become "nicked" or "gouged" due to the moving metal foil continuously contacting the blade in one position. In this respect, the metallic foil is typically moving past a cutter at a high rate of speed, i.e. about 300 feet per minute. A nick or groove in a blade may deform the edges of the foil cut thereby or create fine splinters of metal which may become lodged between layers of foil and affect the quality thereof.

Another method of slitting metallic foils is by means of circular rotating cutters which intersect the path of the moving web. A problem with such blades is that they are generally more expensive than straight edge blades in original cost, set-up time and maintenance (i.e. sharpening and replacement), and rotating blades present a hazardous situation for operators who at times must manually adjust the position of individual blades while a cutting process is underway.

The present invention overcomes these and other problems by providing a device for slitting a continuous moving web of metal foil utilizing a flat blade having a straight cutting edge, which cutting edge is disposed to intersect the moving web of foil and is operable to reciprocally move relative to the moving web while maintaining constant surface contact therewith.

SUMMARY OF THE INVENTION

In accordance with the present invention there is provided a device for slitting a metallic foil which is continuously fed along a path which includes an arcuate portion. The device includes a support base having elongated guide means formed therein which guide means define a generally linear guide path, the support base being positionable adjacent to the arcuate portion of foil path. A blade holder is dimensioned to be received within the guide means and be movable along the guide path. The blade holder is dimensioned to hold a cutting blade having a linear cutting surface wherein the linear cutting surface is oriented generally parallel to the guide path. Reversible drive means are secured to the base means and operable to reciprocally move the blade holder along the guide path at a controllable rate of speed. The support base is positionable such that the cutting surface is generally tangent to the arcuate portion of the foil path with a minimum portion of the cutting surface penetrating the foil.

It is an object of the present invention to provide a device for slitting a metallic foil which is moving at high rates of speed.

Another object of the present invention is to provide a device as described above which minimizes surface contact between the cutting blade and the moving foil.

Another object of the present invention is to provide a device as described above which minimizes localized wearing or abrasion of the cutting surface of the cutting blade.

A still further object of the present invention is to provide a device as described above having a cutting blade which is movable relative to the metal foil, yet maintains constant surface contact between the cutting edge of the blade and the foil.

A still further object of the present invention is to provide a device as described above having a plurality of cutting blades, each of which is reciprocally movable relative to the moving metal foil and each of which was individually controllable with respect to the speed thereof.

These and other objects and advantages of the present invention will become apparent from the following description of a preferred embodiment taken together with the accompanying drawings.

DESCRIPTION OF THE DRAWINGS

The invention may take physical form in certain parts and arrangement of parts, the preferred embodiment of which will be described in detail in the specification and illustrated in the accompanying drawngs wherein.

DETAILED DESCRIPTION OF PREFERRED EMBODIMENT

Figure 2:
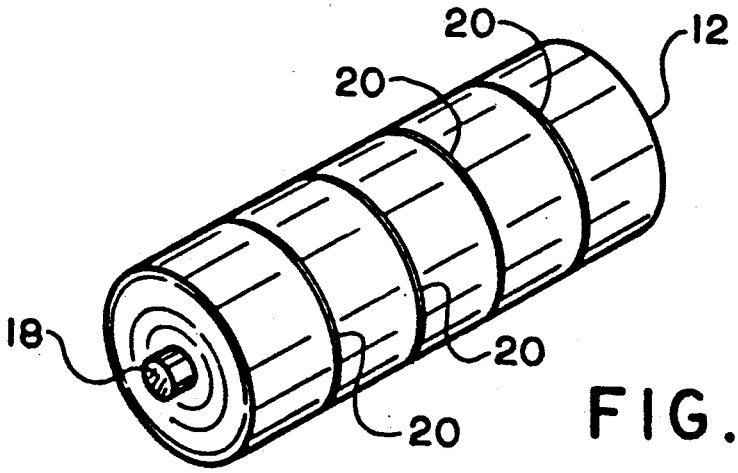
FIG. 2 is a perspective view of a cutter roller used in the assembly shown in FIG. 1.

Referring now to the drawings wherein the showing is for the purpose of illustrating a preferred embodiment of the invention only and not for the purpose of limiting same, the drawings show a advancing slitter knife assembly 10 for slitting a moving web of metallic foil. Knife assembly 10 is adapted to be positioned adjacent a cutting roller 12 which forms a portion of a path for a moving web of foil F. In the embodiment shown, the path of foil F is generally defined by cutting roller 12 and a pair of guide rollers 14, 16. Cutting roller 12, best seen in FIG. 2 is rotatable about an axle 18 and includes a plurality of axially-spaced, annular cutting grooves 20. The space in between adjacent grooves 20 establishes the width of the strips to be cut from foil F. Groove 20 in roller 12 is intended to operate in conjunction with one or more knife assembly 10. Each knife assembly 10 is disposed adjacent cutting roller 12 is generally identical and therefore only one assembly shall be described, it being understood that such description applies equally to other assemblies used in slitting foil F.

Figure 1:
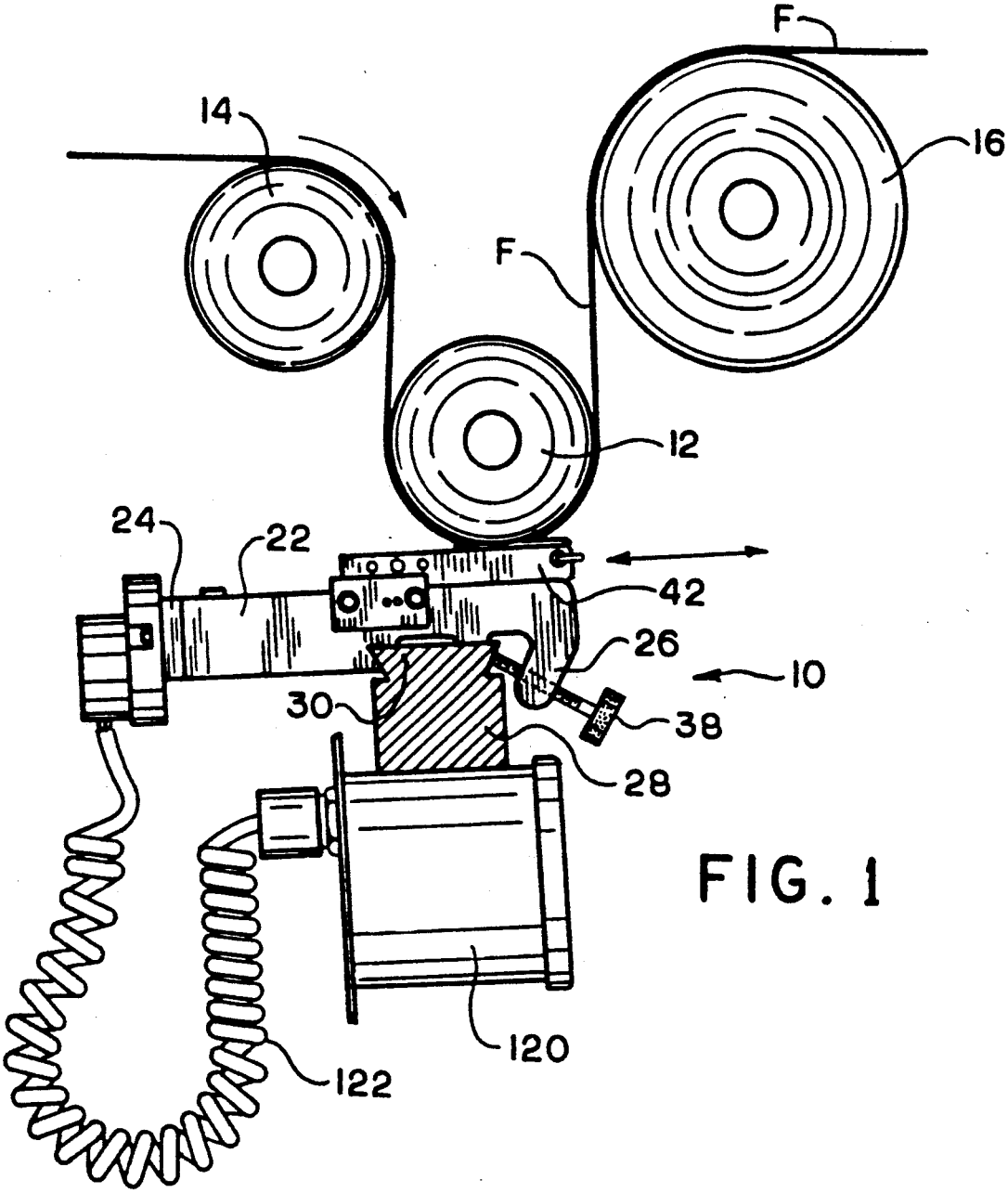
FIG. 1 is a side elevational view showing an advancing slitter knife arrangement illustrating a preferred embodiment of the present invention.
Figure 3:
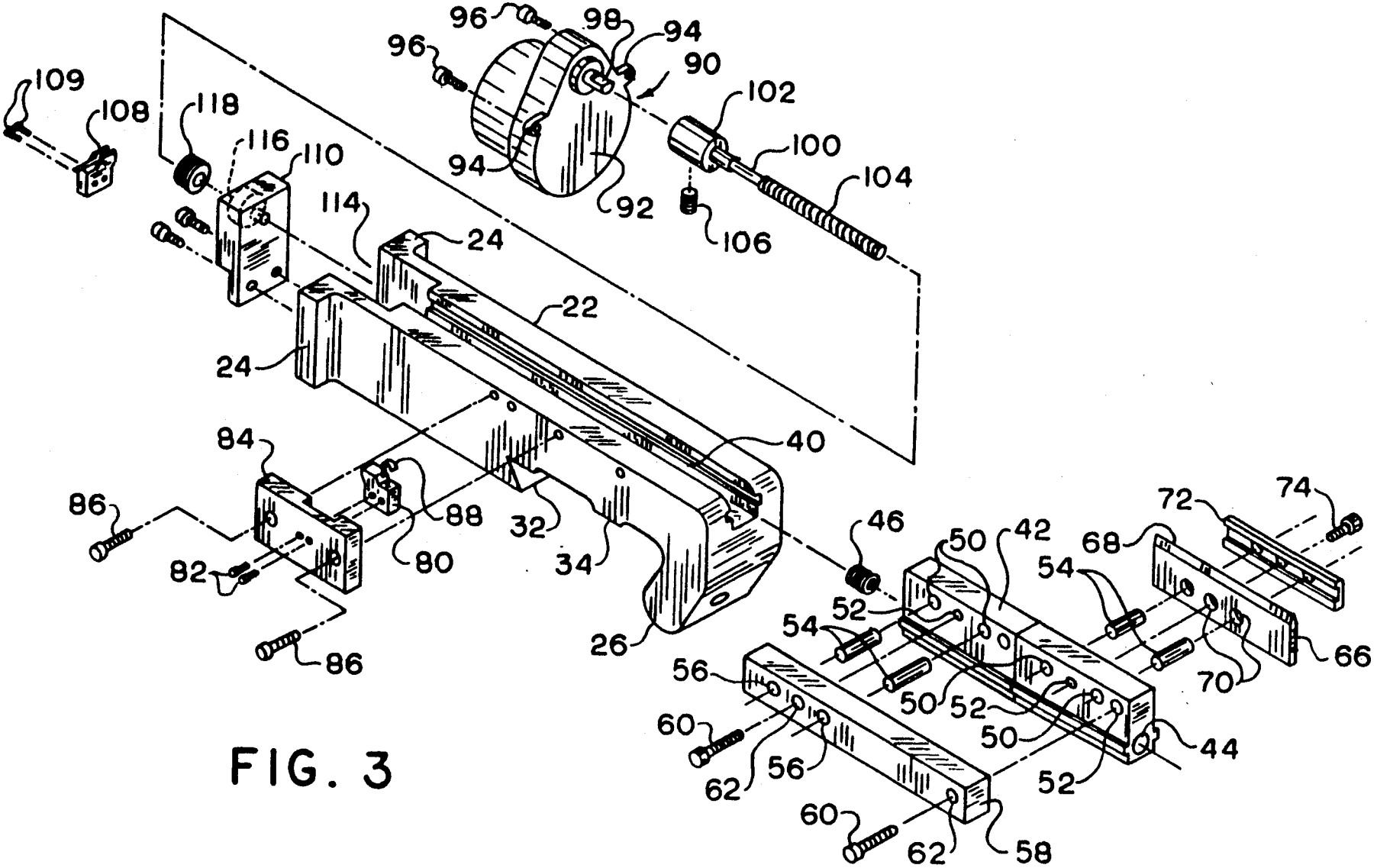
FIG. 3 is an exploded perspective view of a slitter knife cutter assembly illustrating a preferred embodiment of the present invention.

Referring now to FIG. 3 an exploded view of knife assembly 10 is shown. Knife assembly 10 includes an elongated base 22 having a first end formed with laterally extending flanges 24, and a second end having a downward extending projection 26. Base 22 is adapted to be mounted to a support beam 28 (best seen in FIG. 1) which is disposed generally parallel to axle 18 of cutting roller 12. The upper end of support beam 28 is formed to have a dovetail 30 which extends along the length thereof. The underside of beam 22 includes a pair of raised planar guide surfaces 32, 34 dimensioned to rest upon the upper surface of dovetail 30 and to be slidable thereon. A portion of base 22 adjacent surfaces 32, 34 is undercut to form a wedge-shaped relief which is dimensioned to receive dovetail 30 of support beam 28. A thumb screw 38 extends through a threaded opening in projection 26 and is operable to secure base 22 to support beam 28, as best seen in FIG. 1.

An elongated, generally T-shaped slot 40 is formed in the upper surface of base 22. Slot 40 is dimensioned to receive a blade holder 42 therein. Blade holder 42 is elongated and generally rectangular in shape and includes a lower portion dimensioned to matingly correspond to slot 40 and to be reciprocally slidable therein. To this end, blade holder 42 is preferably formed of a plastic material having good self-lubricating properties. In the embodiment shown, blade holder 42 is formed of a thermoplastic acetal resin sold by DuPont de Nemours, E. I. & Company under the trademark DELRIN TM. Blade holder 42 includes a generally cylindrical bore 44 which extends along the longitudinal axis thereof. Bore 44 is dimensioned to be aligned with slot 40 when blade holder 42 is within base 22. An insert 46 (best seen in FIG. 3) is fixedly secured within bore 44 at one end thereof. Insert 46 includes a threaded inner bore (not shown). The upper portion of blade holder 42 includes a plurality of cylindrical bores 50 and threaded bores 52 which are generally transverse to the longitudinal axis of blade holder 42. Bores 50 are dimensioned to receive locating pins 54. One pair of locating pins extends to one side of blade holder 42 and are adapted to be received in holes 56 in an elongated adapter bar 58. Adapter bar 58 is generally rectangular in shape and dimensioned to clamp blade holder 42 within base 22. To this end, holes 56 within adapter bar 58 are positioned so as to align adapter bar 58 with slot 40 in base 22, wherein adapter bar 58 is operable to slide across the upper surface of base 22 and maintain blade holder 42 within base 22. Conventional fasteners 60 extend through opening 62 in adapter bar 58 into threaded holes 52 in blade holder 42 and fixedly secure adapter bar 58 to blade holder 42.

On the other side of blade holder 42, a cutter blade 66 having a linear cutting edge 68 is mounted thereto. Blade 66 includes openings 70 which are dimensioned to receive mounting pins 54. Openings 70 are positioned so as to align cutting edge 68 with blade holder 42 such that edge 68 is generally in parallel alignment with slot 40 of base 22. A mounting clamp 72 and a conventional threaded fastener 74 are provided to secure blade 64 to blade holder 42.

A position sensing switch 80 is provided to monitor the position of blade holder 42 relative to base 22. Switch 80 is secured by fasteners 82 to a mounting block 84, which block 84 is in turn secured to base 22 by fasteners 86. Sensing switch 80 includes a sensing arm 88 which is oriented such that is can operatively engage adapter bar 58. Switch 80 is actuatable when adapter bar 58 has traveled beyond predetermined limits relative to base 22.

At the end of base 22, a motor drive assembly 90 is provided to reciprocally move blade holder 42 through slot 40 in base 22. Motor drive assembly 90 includes a motor housing 92 containing a drive motor and a speed-reducing gear arrangement (not shown). Motor housing 92 includes a pair of mounting lugs 94 having holes therethrough. Conventional fasteners 96 extending through lugs 94 are used to secure motor housing 92 to flanges 24 of base 22. Motor drive assembly 90 includes a drive spindle 98 extending through housing 92. A drive shaft 100 is provided to translate rotational motion of spindle 98 into linear motion of blade holder 42. Drive shaft 100 includes a collar 102 at one end and a threaded shank 104 at the other end. Collar 102 includes an internal bore (not shown) dimensioned to receive motor drive spindle 98 therein and to align motor drive spindle 98 with drive shaft 100. In the embodiment shown, collar 102 includes a side portion (not shown) which is eccentric relative to the common axis of motor drive spindle 98 and drive shaft 100. A set screw 106 is provided to secure collar 102 to spindle 98. Shank 104 is dimensioned and threaded to be matingly received within insert 46 in blade holder 42. In this respect, rotational movement of shank 104 within insert 46 which is rotationally fixed relative thereto produces axial movement of insert 46 relative to shank 104.

A position sensing switch 108 is provided to monitor the rotational movements of drive shaft 100. Switch 108 is positioned to operatively engage the eccentric portion of collar 102 and thereby monitor each revolution thereof. Switch 108 is secured by fasteners 109 to a switch mount 110, which in turn is mounted to a base 22 by threaded fasteners 112. Switch mount 110 is received within a recess 114 formed within base 22. Switch mount 110 includes a counterbored opening 116 disposed to be generally aligned with slot 40. Counterbored opening 116 is dimensioned to receive shank 104 of drive shaft 100 therethrough. Thrust bearings 118 are provided within opening 116 to abut collar 102 of drive shaft 100. Referring now to FIG. 1, motor drive assembly 90 is electrically connected to a junction box 120 by means of an electrical cable 122. A central processing unit (not shown) is connected to motor drive assembly 90 and sensing switches 80, 108. The central processing unit is provided to monitor the relative position and operation of blade holder 42 within base 22 and may be used to control the speed thereof.

Figure 4:
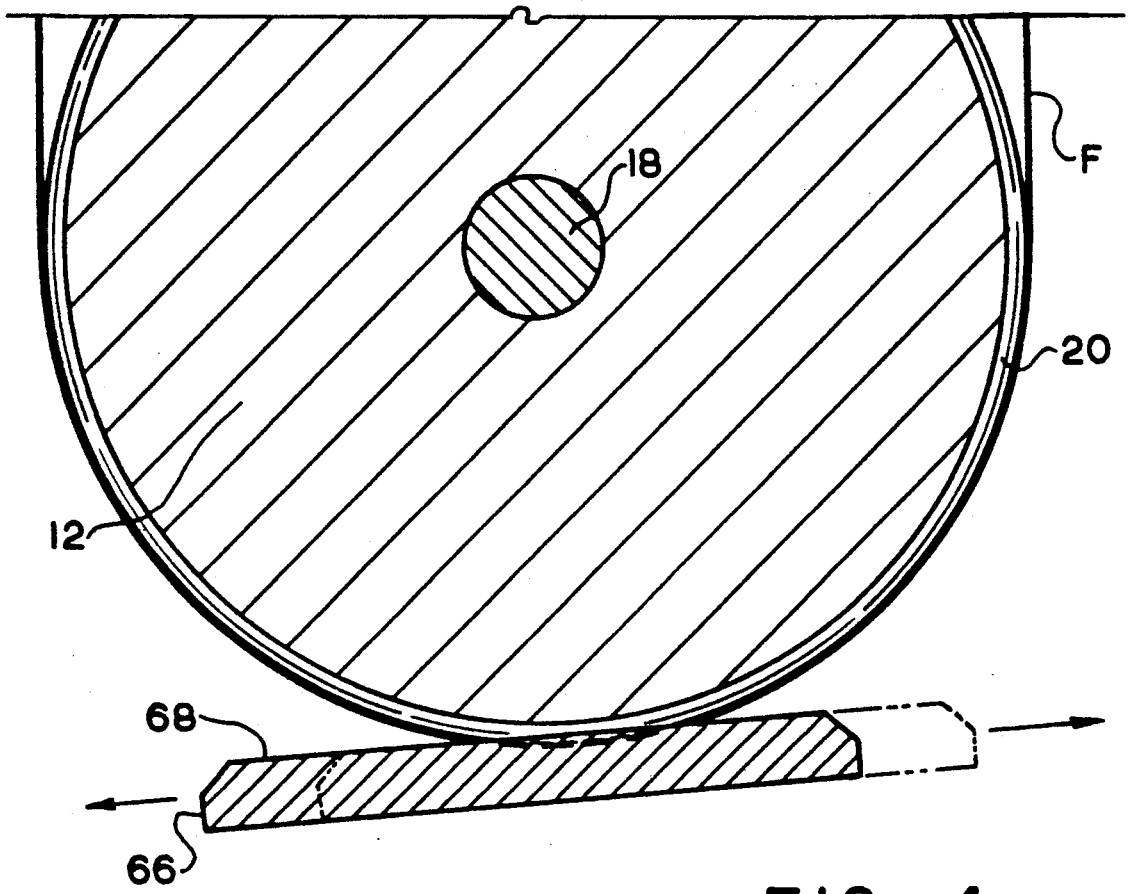
FIG. 4 is an enlarged sectional view illustrating the respective positions of a cutter knife and cutter roller of the assembly shown in FIG. 1.
Figure 5:
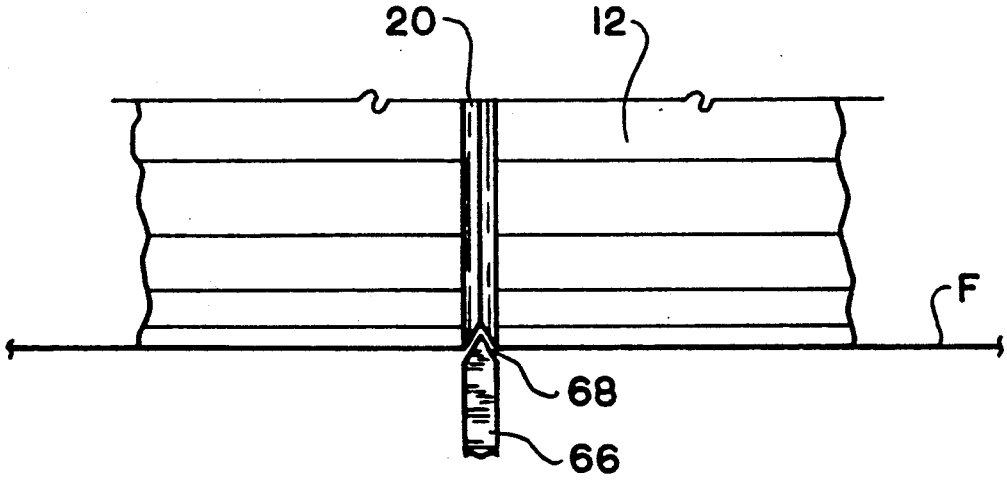
FIG. 5 is a view showing a cutting edge of a cutter blade aligned with a groove in the cutter roller.

Referring now to the operation of knife assembly 10, knife assembly 10 is disposed adjacent cutting roller 12 so as to assume a position best seen in FIGS. 4 and 5, wherein blade 66 is generally tangent to roller 12 and wherein cutting edge 68 of blade 66 is aligned with a groove 20 in cutting roller 12. Cutter blade 66 is preferably positioned such that a minimum portion of linear cutting edge 68 penetrates foil F as best illustrated in FIG. 5. Importantly, foil F moves relative to knife assembly 10 in a direction as shown in FIG. 1. This orientation prevents any trimmed foil from collecting on portions of knife assembly 10 and interfering with the operation thereof. As foil F moves over roller 12, knife assembly 10 is operable to reciprocally move blade 66 along a linear path which is generally tangent to axial 18. Importantly, in as a result of the position of assembly 10 relative to roller 12 (i.e. tangent), the portion of blade 66 penetrating foil F remains constant during reciprocal motion of blade 66. Thus, the thickness of the blade 66 penetrating foil F does not increase or decrease, but remains constant to provide a smooth, uniform cut.

According to the present invention, motor assembly 90 is operable to move blade 66 at a relatively slow and constant rate, preferably in the vicinity of approximately 30 to 40 thousandths of an inch per second. The central processing unit is operable to reverse the direction of motor assembly 90 after a predetermined period of time. In the embodiment shown, the direction of movement of cutter blade 66 is reversed approximately every 37 seconds. As will be appreciated, the period of travel in one direction is based upon the speed of the moving cutter blade 66 and the length of cutting edge 68 thereon.

Sensing switches 80 and 108 provide means by which the central processing unit may monitor operation of slitter knife assembly 10. In this respect, motor assembly 90 includes a constant speed motor wherein the rotational speed of motor drive spindle 98 is known and constant. The speed of drive spindle 98 is programmed into the central processing unit. The processing unit compares this programmed speed against the actual rotational speed of drive spindle 98 as indicated by sensing switch 108 which provides a signal to the central processing unit each time the eccentric portion of collar 102 passes it. In the event that the speed sensed by sensing switch 108 is less than the programmed speed (e.g. if blade holder 42 is jammed or frozen within base 22), the central processor will note the discrepancy and shut down drive motor assembly 90 and can provide a warning signal to the machine operator. In similar respects, sensing switch 80 can signal the central processor in the event that blade holder 42 travels beyond a predetermined range, i.e. where cutting edge 68 of cutter blade 66 is proceeded beyond foil F.

The present invention thus provides a slitter knife assembly for severing continuous sheets of a moving foil which minimizes contact between the foil and cutting surface and prevents nicking or gouging of the cutting surface by slowly reciprocally moving the cutting blade. Importantly, during such reciprocal movement, the surface engaging the moving web remains constant, so as not to deform or alter the severing or slitting of the foil. The present invention also provides monitoring means to maintain and ensure proper operation thereof.

Although the invention has been described with respect to a preferred embodiment, modifications and alterations will occur to others upon their reading and understanding of the present invention. It is intended that all such modifications or alterations be included insofar as they come within the scope of the patent as claimed or equivalents thereof.

Having described the invention, the following is claimed:

1. An assembly for slitting a continuous web of metallic foil comprising:

a roller rotatable about a fixed axis, said roller having a cylindrical outer surface including at least one annular groove formed therein;

an elongated support base having linear guide means formed therein, said guide means defining a generally linear guide path;

a blade holder dimensioned to be received within said guide means and be movable along said guide path, said blade holder dimensioned to hold a cutting blade having a linear cutting surface wherein said linear cutting surface is oriented generally parallel to said guide path;

means for positioning said support base adjacent said roller wherein said cutting surface of said cutting blade is aligned with said annular groove in said roller and a portion of said cutting surface is received therein;

reversible drive means secured to said base means operable to reciprocally move said blade holder along said guide path at a controllable rate of speed; and control means for controlling said drive means, said control means including sensing means operable to monitor movement of said blade holder and the operation of said drive means, said control means monitoring said sensing means to ensure proper operation of said assembly.

2. A device as defined in claim 1 wherein drive means is comprised of an electric stepping motor having an internal step counter and a threaded drive shaft attached to said motor.

3. A device as defined in claim 1 wherein said support base is positioned adjacent said foil such that a minimum portion of said cutting blade engages said foil and said portion is maintained constant as said cutting blade moves reciprocally along said guide path.

4. A device for slitting a metallic foil which is continuously fed along a path including an arcuate portion comprising:

a support base having elongated guide means formed therein, said guide means defining a generally linear guide path, said support base being positionable adjacent said arcuate portion of said foil path;

a blade holder dimensioned to be received within said guide means and be movable along said linear guide path, said blade holder dimensioned to hold a cutting blade having a linear cutting surface wherein said linear cutting surface is oriented generally parallel to said guide path;

reversible drive means secured to said base means operable to reciprocally move said blade holder along said guide path at a controllable rate of speed, said support base being positional such that said cutting surface is generally tangent to said arcuate portion of said foil path a minimum portion of said cutting surface penetrating said foil;

sensing means monitoring movement of said blade holder and monitoring operation of said drive means; and control means monitoring said sensing means for controlling said drive means.

5. A device as defined in claim 4 wherein drive means is comprised of an electric motor having a threaded drive shaft.

6. A device as defined in claim 4 wherein said support base is positioned adjacent said foil such that a minimum portion of said cutting blade engages said foil and said portion is maintained consistent as said cutting blade moves reciprocally along said guide path.

* * * * *